US011349197B2

(12) United States Patent
Wang et al.

(10) Patent No.: US 11,349,197 B2
(45) Date of Patent: May 31, 2022

(54) ANTENNA STRUCTURE AND ELECTRONIC DEVICE

(71) Applicant: Lenovo (Beijing) Co., Ltd., Beijing (CN)

(72) Inventors: Wei Wang, Beijing (CN); Zhiyuan Duan, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 14 days.

(21) Appl. No.: 16/581,057

(22) Filed: Sep. 24, 2019

(65) Prior Publication Data

US 2020/0106163 A1 Apr. 2, 2020

(30) Foreign Application Priority Data

Sep. 27, 2018 (CN) ..... 201811138125.5

(51) Int. Cl.

*H01Q 1/24* (2006.01)
*H01Q 1/36* (2006.01)
*H01Q 3/01* (2006.01)

(52) U.S. Cl.

CPC ..... *H01Q 1/243* (2013.01); *H01Q 1/242* (2013.01); *H01Q 1/364* (2013.01); *H01Q 3/01* (2013.01)

(58) Field of Classification Search

CPC ..... H01Q 1/243; H01Q 1/364; H01Q 1/242; H01Q 3/01; H01Q 1/22; H01Q 1/05

See application file for complete search history.

(56) References Cited

U.S. PATENT DOCUMENTS

| | | | | |
|---|---|---|---|---|
| 6,097,346 | A * | 8/2000 | Fehrenbach | G01F 23/284 343/785 |
| 9,437,922 | B2 | 9/2016 | Dickey et al. | |
| 2014/0139379 | A1 | 5/2014 | Bolin et al. | |
| 2017/0324157 | A1* | 11/2017 | Shurish | H01Q 1/44 |
| 2019/0097315 | A1* | 3/2019 | Chun | H01Q 3/24 |

FOREIGN PATENT DOCUMENTS

| | | | | |
|---|---|---|---|---|
| CN | 101656033 | A | 2/2010 | |
| CN | 202259676 | U | 5/2012 | |
| CN | 103682579 | A | 3/2014 | |
| CN | 103794844 | A | 5/2014 | |
| CN | 106450705 | A | 2/2017 | |
| GB | 2435548 | A | 8/2007 | |
| GB | 2435720 | A | 9/2007 | |
| KR | 100771819 | B1 | 10/2007 | |
| WO | WO-2019234304 | A1 * | 12/2019 | H01M 10/32 |

OTHER PUBLICATIONS

Changzhou Hua et al., "High-Efficiency Sea-Water Monopole Antenna for Maritime Wireless Communications," IEEE Transactions on Antennas and Propagation, vol. 62, No. 12, Dec. 2014, pp. 5968-5973. 6 pages.

* cited by examiner

*Primary Examiner* — Andrea Lindgren Baltzell
*Assistant Examiner* — Yonchan J Kim
(74) *Attorney, Agent, or Firm* — Anova Law Group, PLLC

(57) ABSTRACT

The present disclosure provides an antenna and an electronic device. The antenna includes: a cavity structure configured to contain an electrolyte solution; and a plurality of antenna feed points disposed on the cavity structure. The cavity structure containing the electrolyte solution is configured to be an antenna radiator of the antenna. The plurality of antenna feed points is configured to receive and transmit radio frequency signals.

17 Claims, 2 Drawing Sheets

ANTENNA STRUCTURE AND ELECTRONIC DEVICE

CROSS-REFERENCES TO RELATED APPLICATIONS

This application claims the priority of Chinese Patent Application No. 201811138125.5, filed with the State Intellectual Property Office of P. R. China on Sep. 27, 2018, the entire contents of which are incorporated herein by reference.

FIELD OF THE DISCLOSURE

The present disclosure generally relates to the field of consumer electronics technology and, more particularly, relates to an antenna structure and an electronic device.

BACKGROUND

As consumer's taste for appearance and aesthetics of electronic devices becomes more discriminative, the electronic devices with a strong hi-technology design style are becoming more and more attractive. This is a growing trend in electronic device designs.

In some electronic device designs, the conventional antenna designs lack the hi-technology design style desirable for the electronic devices.

BRIEF SUMMARY OF THE DISCLOSURE

The present disclosure provides an antenna structure and an electronic device to at least partially solve the technical problem in the existing technology.

One aspect of the present disclosure provides an antenna. The antenna includes: a cavity structure configured to contain an electrolyte solution; and a plurality of antenna feed points disposed on the cavity structure. The cavity structure containing the electrolyte solution acts as an antenna radiator of the antenna. The plurality of antenna feed points is configured to receive and transmit radio frequency signals.

In some embodiments, a light transmittance of the cavity structure is greater than a first value and/or the light transmittance of the electrolyte solution contained inside the cavity structure is greater than a second value.

In some embodiments, the cavity structure is transparent or semi-transparent and the electrolyte solution contained inside the cavity structure is transparent or semi-transparent.

In some embodiments, the cavity structure is made of a flexible material or a non-flexible material.

In some embodiments, a conductivity value of the electrolyte solution contained inside the cavity structure is greater than a selected conductivity value.

In some embodiments, a volume of the electrolyte solution contained inside the cavity structure matches a volume of the cavity structure.

In some embodiments, a contact resistance between an antenna feed line and the electrolyte solution contained inside the cavity structure is smaller than a pre-set resistance value.

Another aspect of the present disclosure provides an electronic device. The electronic device includes: an antenna; a receiver configured to receive a radio frequency signal from the antenna; and a transmitter configured to transmit the radio frequency signal to the antenna. The antenna includes: a cavity structure configured to contain an electrolyte solution; and a plurality of antenna feed points disposed on the cavity structure. The cavity structure containing the electrolyte solution acts as an antenna radiator of the antenna and the plurality of antenna feed points is configured to receive and transmit radio frequency signals.

In some embodiments, a portion of the antenna or the entire antenna is transparent and is exposed to the outside of the electronic device.

In some embodiments, the electronic device further includes a partially transparent or completely transparent housing structure. The transparent portion of the antenna or the entire antenna is configured at a location covered by the transparent portion of the housing structure; or the transparent portion of the antenna structure or the entire antenna structure is a part of the transparent portion of the housing structure.

BRIEF DESCRIPTION OF THE DRAWINGS

To more clearly illustrate the technical solution in the present disclosure, the accompanying drawings used in the description of the disclosed embodiments are briefly described hereinafter. The drawings described below are merely some embodiments of the present disclosure. Other drawings may be derived from such drawings by a person with ordinary skill in the art without creative efforts and may be encompassed in the present disclosure.

DETAILED DESCRIPTION

Figure 1:
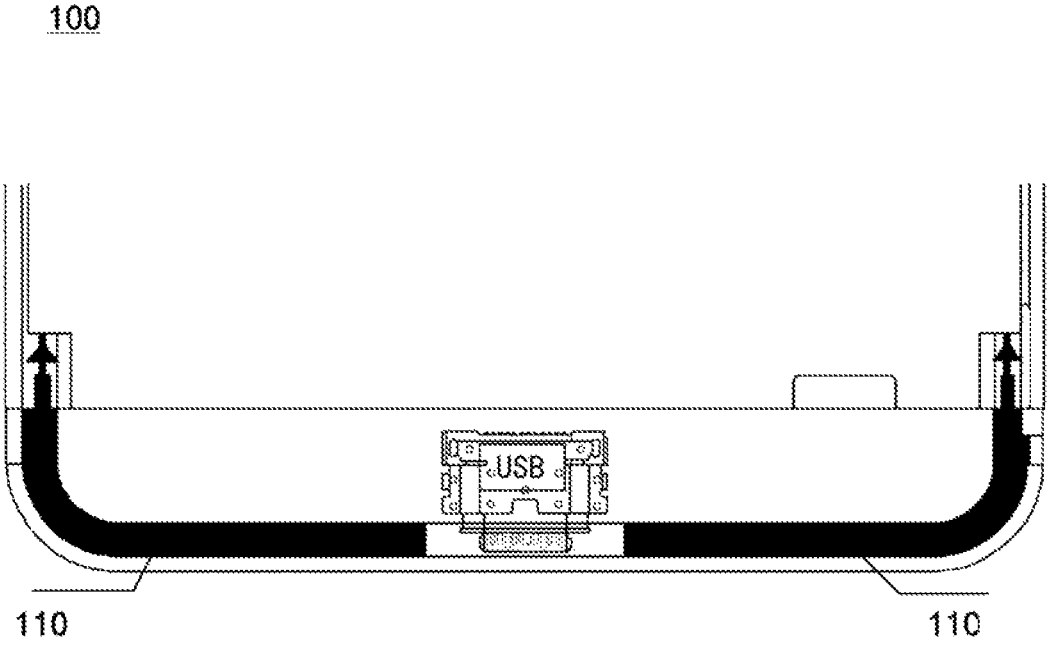
FIG. 1 illustrates an example of an antenna structure according to some embodiments of the present disclosure.

To make the foregoing objectives, features and advantages of the present disclosure clearer and more understandable, the present disclosure will be further described with reference to the accompanying drawings and embodiments. However, exemplary embodiments may be embodied in various forms and should not be construed as limited to the embodiments set forth herein. Rather, these embodiments are provided to fully convey the thorough and complete concepts of the exemplary embodiments to those skilled in the art. However, it is apparent that the one or more embodiments may be implemented without these specific details. In addition, descriptions of well-known structures and techniques are omitted in the following description to avoid unnecessarily obscuring the concept of the present disclosure.

The terminology used herein is for the purpose of describing specific embodiments. The terms "including", "comprising", etc., are used to indicate the presence of features and/or components, but not to exclude the presence or addition of one or more other features or components.

All terms (including technical and scientific terms) used herein have the meaning commonly understood by one of ordinary skill in the art, unless otherwise defined. It should be noted that the terms used herein are to be interpreted as having a meaning consistent with the context of the present specification and should not be interpreted in an ideal or overly rigid manner.

Where an expression similar to "at least one of A, B, and C, etc." is used, it should generally be interpreted in accordance with the meaning of the expression as commonly understood by one of ordinary skill in the art (for example, "a system including at least one of A, B, and C" shall include, but is not limited to, systems including A alone, B alone, C alone, A and B, A and C, B and C, and/or A and B and C, etc.) Where an expression similar to "at least one of A, B, or C, etc." is used, it should generally be interpreted in accordance with the meaning of the expression as commonly understood by one of ordinary skill in the art (for example, "a system including at least one of A, B, or C, etc." shall include, but is not limited to, systems including A alone, B alone, C alone, A and B, B and C, A and C, and/or A and B and C, etc.) Those skilled in the art will also appreciate that transitional conjunctions and/or phrase arbitrarily representing two or more optional items, whether in the specification, claims, or drawings, is to be construed as the possibility of any one of the optional items or any combination of the optional items. For example, the phrase "A and/or B" should be interpreted as including the possibility of "A alone", "B alone", or "A and B".

The present disclosure provides a completely new antenna. A radiator of the antenna consists of a cavity structure and an electrolyte solution contained inside the cavity structure.

The present disclosure also provides an electronic device including the antenna. The electronic device has a totally transparent or semi-transparent housing. The cavity structure of the antenna corresponding to the transparent housing is transparent. Alternatively, the cavity structure of the antenna is part of the transparent housing.

The present disclosure also provides the electronic device including the antenna. The electronic device has a totally transparent or semi-transparent housing. The entire cavity structure of the antenna is made of transparent material. Alternatively, the cavity structure of the antenna is made of the transparent material and includes part of the transparent housing.

In the embodiments of the present disclosure, an electrolyte solution of the antenna is transparent.

The present disclosure provides an antenna structure. The antenna structure includes a cavity structure configured to contain an electrolyte solution and a plurality of antenna feed points disposed on the cavity structure. The cavity structure containing the electrolyte solution acts as an antenna radiator of the antenna structure. The plurality of antenna feed points is configured to receive and transmit radio frequency signals.

FIG. 1 illustrates an example of an antenna structure according to some embodiments of the present disclosure. It should be noted that the FIG. 1 is only an example of one scenario in which the present disclosure may be applied to help those skilled in the art to understand the technical content of the present disclosure, but does not mean that the present disclosure may not be applied to other devices, systems, environments, or scenarios.

As shown in FIG. 1, to support mobile communication, the mobile phone 100 (only the bottom of the mobile phone is shown) requires one or more devices to receive signals and transmit signals, that is, the mobile phone antenna 110. The mobile phone antenna or antennas 110 may be implemented by using the disclosed antenna structure.

The present disclosure provides the antenna structure.

Figure 2:
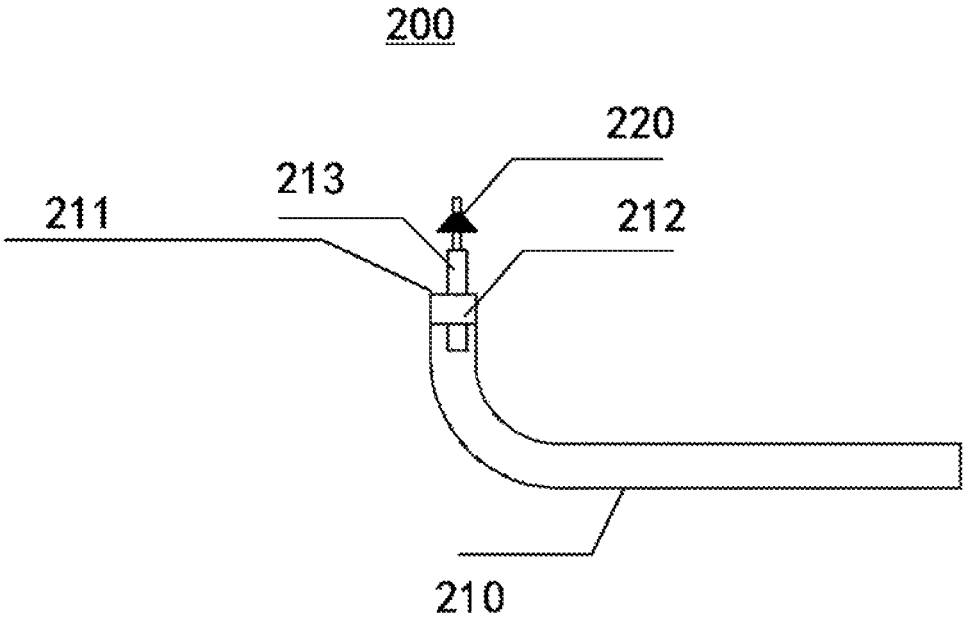
FIG. 2 illustrates a schematic diagram of an example of an antenna structure according to some embodiments of the present disclosure.

FIG. 2 illustrates a schematic diagram of an example of an antenna structure according to some embodiments of the present disclosure.

As shown in FIG. 2, the antenna structure 200 includes a cavity structure 210 configured to contain an electrolyte solution and a plurality of antenna feed points 220 disposed on the cavity structure 210. The cavity structure 210 containing the electrolyte solution acts as an antenna radiator of the antenna structure 200. The plurality of antenna feed points 220 is configured to receive and transmit radio frequency signals.

In one embodiment, the antenna structure 200 can be made into various shapes and various sizes and can be determined according to practical implementation scenarios, which are not limited by the present disclosure. As shown in FIG. 1, to accommodate the shape and size of the mobile phone 100, the antenna structure can be formed as a J-shaped antenna.

In addition, the electrolyte solution refers to a solution in which a solute is completely or partially dissociated into ions after being dissolved in a solvent. The solute is an electrolyte. In one embodiment, the electrolyte solution may include an acid, a base, and a salt solution, which is not limited by the present disclosure.

Because the electrolyte solution is electrically conductive, it can be positively charged by cations and negatively charged by anions, that are dissociated from the electrolyte. Under an external electric field, the cations and the anions move to corresponding electrodes and discharge, thereby achieving electrical conductivity. A sufficient amount of electrolyte solution may be injected into the cavity structure 210 to simulate and replace the antenna radiator in a conventional antenna structure.

In addition, to achieve the functions of receiving the radio frequency signal and transmitting the radio frequency signal, the plurality of antenna feed points 220 are required to be disposed accordingly on the antenna structure 200 as shown in FIG. 2.

In one embodiment, the plurality of antenna feed points 220 may be disposed on the cavity structure 210 in many ways, which are not limited by the present disclosure.

For example, in one embodiment, as shown in FIG. 2, an opening 211 may be configured on one end of the cavity structure 210 and at the same time, a sealing plug 212 with a shape and a size matching the opening 211 may be configured to tightly insert into the opening 211, such that the cavity structure 210 forms a sealed space to contain the electrolyte solution and prevent the electrolyte from leaking. In this case, a metal probe 213 may be inserted into the sealing plug 212. When the sealing plug 212 is inserted into the opening 211, one end of the metal probe 213 may extend into the cavity structure 210 to contact with the electrolyte solution. The other end of the metal probe 213, that is, the end of the metal probe 213 exposed to the outside of the cavity structure 210, may act as an antenna feed point 220.

Figure 3:
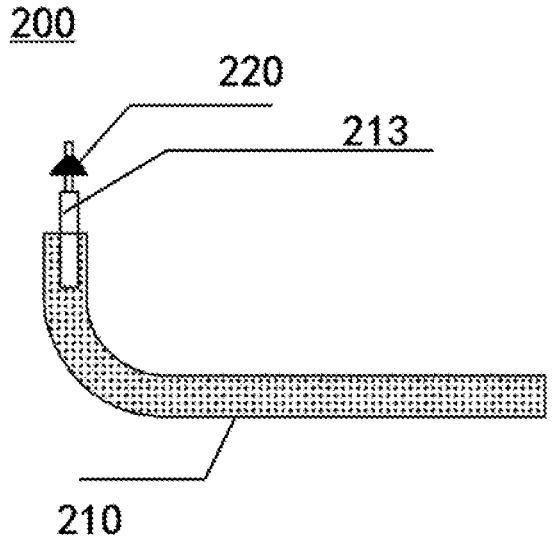
FIG. 3 illustrates a schematic diagram of another example of an antenna structure according to some embodiments of the present disclosure.

In another embodiment, as shown in FIG. 3, the cavity structure 210 is an integrally formed sealed structure. In this case, the integrally formed structure also contains the electrolyte solution sealed inside the cavity structure 210 and the metal probe 213. One end of the metal probe 213 extends into the cavity structure 210 to contact the electrolyte solution and the other end of the metal probe 213 is exposed to the outside of the cavity structure 210 to act as the antenna feed point 220.

The antenna feed point 220 in FIG. 2 is not fixedly arranged while the antenna feed point 220 in FIG. 3 is fixedly arranged. The antenna structures 200 in FIG. 2 and FIG. 3 each has different advantages and disadvantages.

For example, in the antenna structure 200 shown in FIG. 2, the cavity structure 210, the sealing plug 212, the metal probe 213, and the electrolyte solution may be stored separately and may be assembled at the moment of use. The parts are easy to fabricate. For example, the electrolyte solution may be mixed at the moment of use. The concentration, the color, and the transparency of the electrolyte solution may be controlled at the moment of use according to the actual requirements. Thus, the electrolyte solution may be flexibly made to custom requirements. However, in this case, because the sealing structure of the antenna is achieved through the sealing plug 212, any fault in the sealing plug 212 may result in leaking of the electrolyte solution. After the antenna structure 200 is embodied in the electronic device, the leaking of the electrolyte solution may corrode other components, thereby causing substantial damages.

For example, in the antenna structure 200 shown in FIG. 3, the cavity structure 210, the metal probe 213, and the electrolyte solution (indicated by dots in FIG. 3) are integrally formed and may only exist as one entity. The antenna structure 200 can only be fabricated in advance and cannot be assembled at the moment of use. For example, the electrolyte solution must be mixed and sealed inside the cavity structure 210 in advance. As such, once the antenna structure 200 is formed, the concentration, the color, and the transparency of the electrolyte solution cannot be altered. Thus, it is impossible to fabricate to adapt various custom requirements and it can only be fabricated to a specific scenario. However, in this case, because the sealing structure of the antenna is achieved through the integral fabrication, the antenna structure 200 is substantially well sealed. Unless the cavity structure 210 is broken, it is unlikely to cause leaking of the electrolyte solution. The electronic device embodying the antenna structure 200 shown in FIG. 3 is safer to use as compared to the electronic device embodying the antenna structure 200 shown in FIG. 2.

In one embodiment, when the antenna structure 200 is applied to the electronic device, the antenna feed point 220 may be implemented by an antenna feed line, that is, the metal probe. For example, one end of the antenna feed line extends into the cavity structure 210 and the other end may be connected to the receiver and the transmitter of the electronic device through a switch or a duplexer (or a multiplexer).

In a TDD mode, that is, when the receiver and the transmitter share a same frequency band, the antenna feed line may be connected to the receiver and the transmitter through the switch. In an FDD mode, that is, when the receiver and the transmitter do not share a same frequency band, the antenna feed line may be connected to the receiver and the transmitter through the duplexer (or the multiplexer).

Conventional antennas are ordinary antennas made of copper or aluminum and are lack of the strong sense of technology. In the embodiments of the present disclosure, electrolyte solution is injected into the cavity structure to form a new type of antenna structure, thereby infusing the strong sense of technology into products.

In one embodiment, a light transmittance of the cavity structure is greater than a first pre-set value and/or the light transmittance of the electrolyte solution contained inside the cavity structure is greater than a second pre-set value.

That is, the present disclosure includes three solutions. In solution 1, the light transmittance of the cavity structure is greater than the first pre-set value and the light transmittance of the electrolyte solution contained inside the cavity structure is greater than the second pre-set value. In solution 2, only the light transmittance of the cavity structure is greater than the first pre-set value and the light transmittance of the electrolyte solution contained inside the cavity structure is not greater than the second pre-set value. In solution 3, only the light transmittance of the electrolyte solution contained inside the cavity structure is greater than the second pre-set value and the light transmittance of the cavity structure is not greater than the first pre-set value.

Because the light transmittance of the cavity structure determines the transparency of the cavity structure and the light transmittance of the electrolyte solution determines the transparency of the electrolyte solution, the cavity structures with different light transmittances and electrolyte solutions with different light transmittances may be selected to fabricate the antenna structures with different light transmittances, such as, non-transparent antennas, semi-transparent antennas, or transparent antennas.

In one embodiment, the cavity structure may be fabricated transparent or semi-transparent. At the same time, the electrolyte solution contained inside the cavity structure may be mixed transparent or semi-transparent. As such, the transparent antennas or the semi-transparent antennas may be fabricated, thereby meeting the requirement for a transparent design of the electronic device.

In one embodiment, the cavity structure may be made of a flexible material or a non-flexible material.

In one embodiment, the flexible material and the non-flexible material used in fabricating the cavity structure may not be a conductive material. The non-flexible material including, but not limited to, glass and resin, etc. may be used to fabricate antennas of a fixed shape, suitable for a highly customized scenario of a particular type of electronic devices. The antennas made of the flexible material may be adapted to various customized scenarios. For example, a same antenna made of the flexible material may be adapted to the electronic devices of various shapes.

In one embodiment, conductivity of the electrolyte solution contained inside the cavity structure is greater than a pre-set conductivity value.

Because conventional antennas are made of metallic materials, the conventional antennas have sufficiently high conductivity. To ensure the antennas fabricated by injecting the electrolyte solution into the cavity structure have a conductivity similar to the metal antennas, the electrolyte solution contained inside the cavity structure may be selected to have a sufficiently high conductivity, such as at a level of $10^7$ S/m.

In one embodiment, a volume of the electrolyte solution contained inside the cavity structure matches a volume of the cavity structure.

For example, to satisfy various appearance requirements, the electrolyte solution injected into the cavity structure may fill the entire cavity structure or may not fill the entire cavity structure. The electrolyte solution may not have to fill the entire cavity structure as long as an electric current flows continuously and the receiving and transmitting functions of the antenna remain intact.

In one embodiment, a contact resistance between the antenna feed line and the electrolyte solution contained inside the cavity structure is smaller than a pre-set resistance value.

For example, sufficiently strong electric current signals ensure that the receiving and transmitting functions of the antenna are normal. The antenna feed line is selected to satisfy the requirement for a substantially small contact resistance between the electrolyte solution and the antenna feed line. In one embodiment, the contact resistance is smaller than 1 ohm.

The present disclosure also provides an electronic device.

Figure 4:
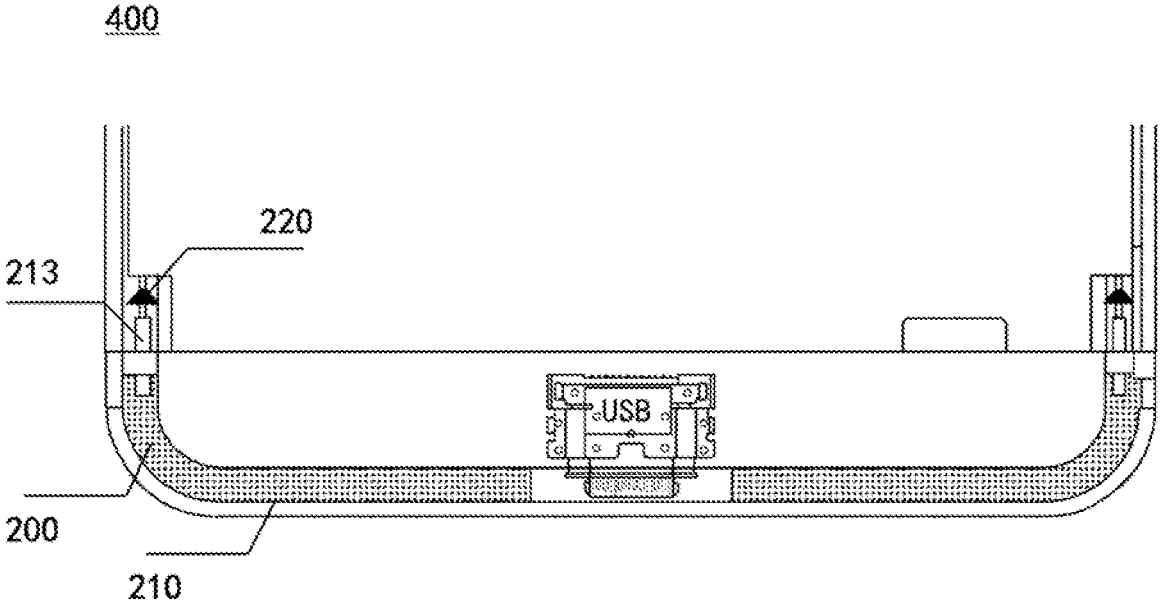
FIG. 4 illustrates a partial schematic view of an electronic device according to some embodiments of the present disclosure.

FIG. 4 illustrates a partial schematic view of an electronic device according to some embodiments of the present disclosure.

As shown in FIG. 4, the electronic device 400 (only the bottom of the electronic device is shown in FIG. 4) includes an antenna structure 200. The antenna structure 200 includes a cavity structure 210 configured to contain an electrolyte solution (indicated by dots in FIG. 4) and a plurality of antenna feed points 220 disposed on the cavity structure 210. The cavity structure 210 containing the electrolyte solution acts as an antenna radiator of the antenna structure 200. The plurality of antenna feed points 220 is configured to receive and transmit radio frequency signals. The electronic device 400 further includes a receiver (not shown) configured to receive a radio frequency signal from the antenna structure 200 and a transmitter (not shown) configured to transmit the radio frequency signal to the antenna structure 200.

In one embodiment, the antenna structure 200 can be made into various shapes and various sizes and can be determined according to practical implementation scenarios, which are not limited by the present disclosure. As shown in FIG. 1, to accommodate the shape and size of the mobile phone 100, the antenna structure can be formed as a J-shaped antenna.

In addition, the electrolyte solution refers to a solution in which a solute is completely or partially dissociated into ions after being dissolved in a solvent. The solute is an electrolyte. In one embodiment, the electrolyte solution may include an acid, a base, and a salt solution, which is not limited by the present disclosure.

Because the electrolyte solution is electrically conductive, it can be positively charged by cations and negatively charged by anions, that are dissociated from the electrolyte. Under an external electric field, the cations and the anions move to corresponding electrodes and discharge, thereby achieving electrical conductivity. A sufficient amount of electrolyte solution may be injected into the cavity structure 210 to simulate and replace the antenna radiator in a conventional antenna structure.

In addition, to achieve the functions of receiving the radio frequency signal and transmitting the radio frequency signal, the plurality of antenna feed points 220 are required to be disposed accordingly on the antenna structure 200 as shown in FIG. 2.

In one embodiment, the plurality of antenna feed points 220 may be disposed on the cavity structure 210 in many ways, which are not limited by the present disclosure.

For example, in one embodiment, as shown in FIG. 2, an opening 211 may be configured on one end of the cavity structure 210 and at the same time, a sealing plug 212 with a shape and a size matching the opening 211 may be configured to tightly insert into the opening 211, such that the cavity structure 210 forms a sealed space to contain the electrolyte solution and prevent the electrolyte from leaking. In this case, a metal probe 213 may be inserted into the sealing plug 212. When the sealing plug 212 is inserted into the opening 211, one end of the metal probe 213 may extend into the cavity structure 210 to contact with the electrolyte solution. The other end of the metal probe 213, that is, the end of the metal probe 213 exposed to the outside of the cavity structure 210, may act as an antenna feed point 220.

In another embodiment, as shown in FIG. 3, the cavity structure 210 is an integrally formed sealed structure. In this case, the integrally formed structure also contains the electrolyte solution sealed inside the cavity structure 210 and the metal probe 213. One end of the metal probe 213 extends into the cavity structure 210 to contact the electrolyte solution and the other end of the metal probe 213 is exposed to the outside of the cavity structure 210 to act as the antenna feed point 220.

The antenna feed point 220 in FIG. 2 is not fixedly arranged while the antenna feed point 220 in FIG. 3 is fixedly arranged. The antenna structures 200 in FIG. 2 and FIG. 3 each has different advantages and disadvantages.

For example, in the antenna structure 200 shown in FIG. 2, the cavity structure 210, the sealing plug 212, the metal probe 213, and the electrolyte solution may be stored separately and may be assembled at the moment of use. The parts are easy to fabricate. For example, the electrolyte solution may be mixed at the moment of use. The concentration, the color, and the transparency of the electrolyte solution may be controlled at the moment of use according to the actual requirements. Thus, the electrolyte solution may be flexibly made to custom requirements. However, in this case, because the sealing structure of the antenna is achieved through the sealing plug 212, any fault in the sealing plug 212 may result in leaking of the electrolyte solution. After the antenna structure 200 is embodied in the electronic device, the leaking of the electrolyte solution may corrode other components, thereby causing substantial damages.

For example, in the antenna structure 200 shown in FIG. 3, the cavity structure 210, the metal probe 213, and the electrolyte solution (indicated by dots in FIG. 3) are integrally formed and may only exist as one entity. The antenna structure 200 can only be fabricated in advance and cannot be assembled at the moment of use. For example, the electrolyte solution must be mixed and sealed inside the cavity structure 210 in advance. As such, once the antenna structure 200 is formed, the concentration, the color, and the transparency of the electrolyte solution cannot be altered. Thus, it is impossible to fabricate to adapt various custom requirements and it can only be fabricated to a specific scenario. However, in this case, because the sealing structure of the antenna is achieved through the integral fabrication, the antenna structure 200 is substantially well sealed. Unless the cavity structure 210 is broken, it is unlikely to cause leaking of the electrolyte solution. The electronic device embodying the antenna structure 200 shown in FIG. 3 is safer to use as compared to the electronic device embodying the antenna structure 200 shown in FIG. 2.

In one embodiment, when the antenna structure 200 is applied to the electronic device, the antenna feed point 220 may be implemented by an antenna feed line, that is, the metal probe. For example, one end of the antenna feed line extends into the cavity structure 210 and the other end may be connected to the receiver and the transmitter of the electronic device through a switch or a duplexer (or a multiplexer).

In a TDD mode, that is, when the receiver and the transmitter share a same frequency band, the antenna feed line may be connected to the receiver and the transmitter through the switch. In an FDD mode, that is, when the receiver and the transmitter do not share a same frequency band, the antenna feed line may be connected to the receiver and the transmitter through the duplexer (or the multiplexer).

Conventional antennas are ordinary antennas made of copper or aluminum and are lack of the strong sense of technology. In the embodiments of the present disclosure, electrolyte solution is injected into the cavity structure to form a new type of antenna structure, thereby infusing the strong sense of technology into products.

In one embodiment, some or all antenna structure may be transparent and may be exposed to the outside of the electronic device. Thus, the transparent design of the electronic device is supported.

In one embodiment, the electronic device further includes: a partially transparent or a completely transparent housing structure. The transparent portion of the antenna structure or the entire antenna structure may be configured at a location covered by the transparent portion of the housing structure. In this case, the antenna structure is concealed and is not exposed. However, because the housing structure of the electronic device is completely transparent or the portion of the housing structure covering the antenna structure is transparent, the antenna structure is transparently visible. Thus, the transparent design of the electronic device is supported. Alternatively, the transparent portion of the antenna structure or the entire antenna structure becomes the transparent portion of the housing structure. For example, the housing structure is partially transparent. The transparent portion of the housing structure is the transparent antenna structure. In this case, the antenna structure becomes a part of the housing structure, thereby supporting the transparent design of the electronic device.

Taking the mobile phone as an example, a sealed cavity structure 210 in a suitable size may be configured at the bottom of the mobile phone shown in FIG. 4. A special highly conductive electrolyte solution may be injected into the cavity structure 210. The cavity structure 210 is then sealed to prevent leaking of the solution. At the same time, a conductive probe (e.g., a metal probe) may extend into the sealed cavity structure 210 to electrically contact the electrolyte solution, thereby achieving the antenna function. As shown in FIG. 4, antenna signals enter the inside of the sealed cavity structure 210 through the antenna feed point 220 and the conductive probe (e.g., the metal probe 213). The bottom of the mobile phone is made of a transparent material (e.g., glass, resin, etc.). The inside of the transparent material is removed to form a sealed cavity. The cavity is injected with a transparent and conductive electrolyte solution. The radio frequency signals of the mobile phone are fed into the solution through the metal probe 213 to form electric current oscillation, thereby achieving the radiation function of the antenna. The frequency band covered by the antenna may be adjusted by adjusting a coupling circuit and the physical size of the cavity.

In one embodiment, a light transmittance of the cavity structure is greater than a first pre-set value and/or the light transmittance of the electrolyte solution contained inside the cavity structure is greater than a second pre-set value.

That is, the present disclosure includes three solutions. In solution 1, the light transmittance of the cavity structure is greater than the first pre-set value and the light transmittance of the electrolyte solution contained inside the cavity structure is greater than the second pre-set value. In solution 2, only the light transmittance of the cavity structure is greater than the first pre-set value and the light transmittance of the electrolyte solution contained inside the cavity structure is not greater than the second pre-set value. In solution 3, only the light transmittance of the electrolyte solution contained inside the cavity structure is greater than the second pre-set value and the light transmittance of the cavity structure is not greater than the first pre-set value.

Because the light transmittance of the cavity structure determines the transparency of the cavity structure and the light transmittance of the electrolyte solution determines the transparency of the electrolyte solution, the cavity structures with different light transmittances and electrolyte solutions with different light transmittances may be selected to fabricate the antenna structures with different light transmittances, such as, non-transparent antennas, semi-transparent antennas, or transparent antennas.

In one embodiment, the cavity structure may be fabricated transparent or semi-transparent. At the same time, the electrolyte solution contained inside the cavity structure may be mixed transparent or semi-transparent. As such, the transparent antennas or the semi-transparent antennas may be fabricated, thereby meeting the requirement for a transparent design of the electronic device.

In one embodiment, the cavity structure may be made of a flexible material or a non-flexible material.

In one embodiment, the flexible material and the non-flexible material used in fabricating the cavity structure may not be a conductive material. The non-flexible material including, but not limited to, glass and resin, etc. may be used to fabricate antennas of a fixed shape, suitable for a highly customized scenario of a particular type of electronic devices. The antennas made of the flexible material may be adapted to various customized scenarios. For example, a same antenna made of the flexible material may be adapted to the electronic devices of various shapes.

In one embodiment, conductivity of the electrolyte solution contained inside the cavity structure is greater than a pre-set conductivity value.

Because conventional antennas are made of metallic materials, the conventional antennas have sufficiently high conductivity. To ensure the antennas fabricated by injecting the electrolyte solution into the cavity structure have a conductivity similar to the metal antennas, the electrolyte solution contained inside the cavity structure may be selected to have a sufficiently high conductivity, such as at a level of $10^7$.

In one embodiment, a volume of the electrolyte solution contained inside the cavity structure matches a volume of the cavity structure.

For example, to satisfy various appearance requirements, the electrolyte solution injected into the cavity structure may fill the entire cavity structure or may not fill the entire cavity structure. The electrolyte solution may not have to fill the entire cavity structure as long as an electric current flows continuously and the receiving and transmitting functions of the antenna remain intact.

In one embodiment, a contact resistance between the antenna feed line and the electrolyte solution contained inside the cavity structure is smaller than a pre-set resistance value.

For example, sufficiently strong electric current signals ensure that the receiving and transmitting functions of the antenna are normal. The antenna feed line is selected to satisfy the requirement for a substantially small contact resistance between the electrolyte solution and the antenna feed line. In one embodiment, the contact resistance is smaller than 1 ohm.

It should be understood that, features described in the embodiments of the present disclosure and/or the claims may be reconfigured or combined with each other even if such reconfiguration or combination are not explicitly described in the present specification. Particularly, without departing from the spirit and scope of the present disclosure, the features described in the embodiments of the present disclosure and/or the claims may be reconfigured and/or combined with each other. All such reconfigurations and/or combinations fall within the scope of the present disclosure.

Various embodiments have been described to illustrate the operation principles and exemplary implementations. It should be understood by those skilled in the art that the present disclosure is not limited to the specific embodiments described herein and that various other obvious changes, rearrangements, and substitutions will occur to those skilled in the art without departing from the scope of the disclosure. Thus, while the present disclosure has been described in detail with reference to the above described embodiments, the present disclosure is not limited to the above described embodiments, but may be embodied in other equivalent forms without departing from the scope of the present disclosure, which is determined by the appended claims.

What is claimed is:

1. An antenna, comprising:

a cavity structure configured to contain an electrolyte solution, the cavity structure including a short portion and a long portion, and including an opening on one end of the short portion of the cavity structure, the cavity structure containing the electrolyte solution being configured to be an antenna radiator of the antenna;

a sealing plug inserted in the opening;

a metal probe inserted in the sealing plug; and a plurality of antenna feed points disposed on the cavity structure and configured to receive and transmit radio frequency signals, the plurality of antenna feed points including at least one end of the metal probe;

wherein:

the antenna is installed in a partially or completely transparent housing structure of an electronic device; and a transparent portion of the antenna is a transparent portion of the housing structure.

2. The antenna according to claim 1, wherein:

a light transmittance value of the cavity structure is greater than a first value; and the light transmittance value of the electrolyte solution contained inside the cavity structure is greater than a second value.

3. The antenna according to claim 2, wherein:

the cavity structure is transparent or semi-transparent; and the electrolyte solution contained inside the cavity structure is transparent or semi-transparent.

4. The antenna according to claim 1, wherein:

the cavity structure is made of a flexible material or a non-flexible material.

5. The antenna according to claim 1, wherein:

a conductivity value of the electrolyte solution contained inside the cavity structure is greater than a selected conductivity value.

6. The antenna according to claim 1, wherein:

a volume of the electrolyte solution contained inside the cavity structure corresponds to a volume of the cavity structure.

7. The antenna according to claim 1, wherein:

a contact resistance between an antenna feed line and the electrolyte solution contained inside the cavity structure is smaller than a selected resistance value.

8. An electronic device, comprising:

an antenna including:

a cavity structure configured to contain an electrolyte solution, the cavity structure including a short portion and a long portion, and including an opening on one end of the short portion of the cavity structure, the cavity structure containing the electrolyte solution being configured to be an antenna radiator of the antenna;

a sealing plug inserted in the opening;

a metal probe inserted in the sealing plug; and a plurality of antenna feed points disposed on the cavity structure and configured to receive and transmit radio frequency signals, the plurality of antenna feed points including at least one end of the metal probe;

a receiver configured to receive one or more of the radio frequency signals from the antenna;

a transmitter configured to transmit another one or more of the radio frequency signals to the antenna; and a partially transparent or completely transparent housing structure, a transparent portion of the antenna being a transparent portion of the housing structure.

9. The electronic device according to claim 8, wherein:

the transparent portion of the antenna is exposed to the outside of the electronic device.

10. The electronic device according to claim 8, wherein:

the entire antenna is transparent and is exposed to the outside of the electronic device.

11. The electronic device according to claim 9, wherein:

the transparent portion of the antenna is configured at a location covered by the transparent portion of the housing structure.

12. The electronic device according to claim 10, wherein:

the entire antenna is configured at a location covered by the transparent portion of the housing structure.

13. The electronic device according to claim 10, wherein:

the entire antenna is the transparent portion of the housing structure.

14. The electronic device according to claim 9, wherein a color of the electrolyte solution corresponds to a design of the electronic device.

15. The antenna according to claim 1, wherein the metal probe is inserted in the sealing plug and into the cavity structure from an end surface of the short portion in an extension direction of the short portion.

16. The electronic device according to claim 8, wherein:

each of the plurality of antenna feed points includes an antenna feed line configured to:

be connected to the receiver and the transmitter through a switch in response to the receiver and the transmitter sharing a same frequency band; and be connected to the receiver and the transmitter through a duplexer in response to the receiver and the transmitter not sharing the same frequency band.

17. The antenna according to claim 1, wherein the cavity structure is a first cavity structure;

the antenna further comprising:

a second cavity structure formed in a J-shape and having a similar configuration as the first cavity structure;

wherein the first cavity structure and the second cavity structure are arranged symmetrical to each other and together form a U-shape.

* * * * *